United States Patent [19]

Prusak

[11] Patent Number: 4,522,659

[45] Date of Patent: Jun. 11, 1985

[54] METHOD AND APPARATUS FOR THE MANUFACTURE OF RECORD STAMPERS

[75] Inventor: John J. Prusak, Indianapolis, Ind.

[73] Assignee: RCA Corporation, Princeton, N.J.

[21] Appl. No.: 594,822

[22] Filed: Mar. 29, 1984

[51] Int. Cl.[3] ..... C22F 1/00; C22F 1/10

[52] U.S. Cl. ..... 148/11.5 R; 148/11.5 N; 148/11.5 Q; 266/249; 369/283; 425/810

[58] Field of Search ..... 148/11.5 Q, 11.5 N, 148/11.5 R; 369/283; 425/810; 266/249

[56] References Cited

U.S. PATENT DOCUMENTS 3,932,097 1/1976 Press ..... 425/810
4,057,831 11/1977 Jacobs et al. ..... 369/283
4,363,844 12/1982 Lewis et al. ..... 369/283
4,414,167 11/1983 Prusak et al. ..... 425/810
4,478,566 10/1984 Prusak et al. ..... 425/810

*Primary Examiner*—Wayland Stallard
*Attorney, Agent, or Firm*—Birgit E. Morris; Edward J. Sites

[57] ABSTRACT

An improved method and apparatus is provided for the manufacture of stampers in which the stampers are electroformed from a relatively hard metal in a flat configuration and then, either before or after shaping of the shaped inner and outer edges, but prior to the use in the pressing of records, the inner and/or outer edges are selectively annealed to increase the ductility of these portions while retaining hardness of the remainder of the stamper.

10 Claims, 4 Drawing Figures

METHOD AND APPARATUS FOR THE MANUFACTURE OF RECORD STAMPERS

This invention relates to a method and apparatus for manufacture of stampers used in the pressing of molded records. More particularly, this invention is concerned with an improved method and apparatus for shaping the inner and outer edges of stampers so as to increase the useful life of the stampers.

BACKGROUND OF THE INVENTION

In the manufacture of molded records, such as conventional audio records or the more recently developed capacitive electronic discs, a thermoplastic composition is molded between a pair of metal disc-shaped parts referred to as stampers. Each of the stampers has defined in its molding surface a spiral information track which contains a surface relief pattern corresponding to the program information desired to be reproduced on playback of a molded record pressed with the stampers.

Stampers are the end product of a multi-step process which is broadly referred to as matrixing. The first step of the matrixing process is to record the program information on a magnetic tape. The magnetic tape is used to control a tool which cuts a recording substrate with a spiral information track having a surface relief pattern corresponding to the recorded program information. The recording substrates which are conventionally employed are flat metal discs which have a layer of a relatively soft material formed on one surface thereof into which the spiral information track is cut.

The recording substrate having the spiral information track cut into its surface is replicated in a series of electroforming steps. In the first of the electroforming steps, a metal, such as nickel, is electrodeposited on the surface of the recording substrate until a self-substaining part of a predetermined thickness is obtained. The resulting electroformed part, called a master, is separated from the recording substrate. The master is, in turn, replicated by electrodepositing a metal, again, such as nickel, onto the surface of the master. After a predetermined thickness of metal has been deposited on the master, the resulting replica, referred to as a mother, is separated from the surface of the master. The mother which is obtained is, in turn, replicated to produce the part referred to as a stamper. The stamper which is obtained is a negative replica of the recording substrate having formed in its molding surface a mirror image of the spiral information track which was cut into the recording substrate and is a flat disc-shaped part like the recording substrate.

The stampers obtained directly from the matrixing process described above are not suitable as formed for use with the presses conventionally employed in the molding of records. The flat stampers obtained from the matrixing process could more properly be called stamper blanks in that they must be subjected to a number of edge shaping steps in order to have the required edge configuration for mounting on a molding platen of a record molding press. The edges of flat stampers from the matrixing process are initially trimmed. An inner edge is formed in the flat stampers by cutting a center hole into the flat stampers of a precise diameter concentric with the recorded area of the stampers. The outer edge of the flat stampers is also trimmed to a precise diameter concentric with the recorded area of the stampers. After the stampers are trimmed, the inner and outer edges are further shaped in stamping operations. The inner edge is stamped so as to form a tube-like extension about the inner edge which is used to secure the center portion of the stamper to the molding platen. The outer edge of the stamper is likewise shaped in a stamping operation which results in the outer edge being shaped so as to form an outer bead on the molded record as well as to form the flash and provide a land area for the molding process. In addition, a circumferential portion is formed about at the outermost diameter for engaging the outer edge of the molding platen.

The requirements for shaping of the inner and outer edges of the stampers are a source of considerable problems. It is highly desirable that the stampers be as hard as possible so as to resist scratching, dents and other types of mechanical damage during handling and pressing. However, since the flat stampers from the matrixing process are required to be shaped in stamping operations, as noted above, it is necessary that the metal of the stampers be sufficiently ductile to permit deformation without cracking when the stampers are shaped, or, thereafter, when they are used in the molding process. The requirement for ductility of stampers manufactured by the above-described matrixing process has resulted in an undesirable trade-off of hardness in order to improve ductility. Furthermore, it has been found that despite compromises being made in the hardness of the stampers in order to obtain increased ductility, almost all of the problems encountered with the stampers during the pressing of records can be traced directly back to the stamping steps used to shape the inner and outer edges. The stampers, prepared as described above, when used in the molding process, usually fail as a result of fatigue cracking at the shaped inner or outer edges of the stampers. This is believed to be due to stresses introduced into the shaped inner and outer edges during stamping.

What would be highly desirable would be an improved method for the manufacture of stampers having increased hardness in the recorded areas and increased resistance to fatigue cracking in the shaped inner and outer edges.

BRIEF SUMMARY OF THE INVENTION

An improved method and apparatus is provided for the manufacture of stampers in which the stampers are electroformed from a relatively hard metal in a flat configuration and then, either before or after shaping of the shaped inner and outer edges, cut prior to use in the pressing of records, the inner and/or outer edges are selectively annealed to increase the ductility of these portions while retaining hardness of the remainder of the stamper.

DETAILED DESCRIPTION

In describing the present invention, specific reference will be made to the structural features of the stamper illustrated in FIG. 1. It should be appreciated, however, that the disclosed invention is not limited to the specific stamper configuration illustrated in FIG. 1, but can be used with various types of stamper configurations having shaped inner and/or outer edges.

Figure 1:
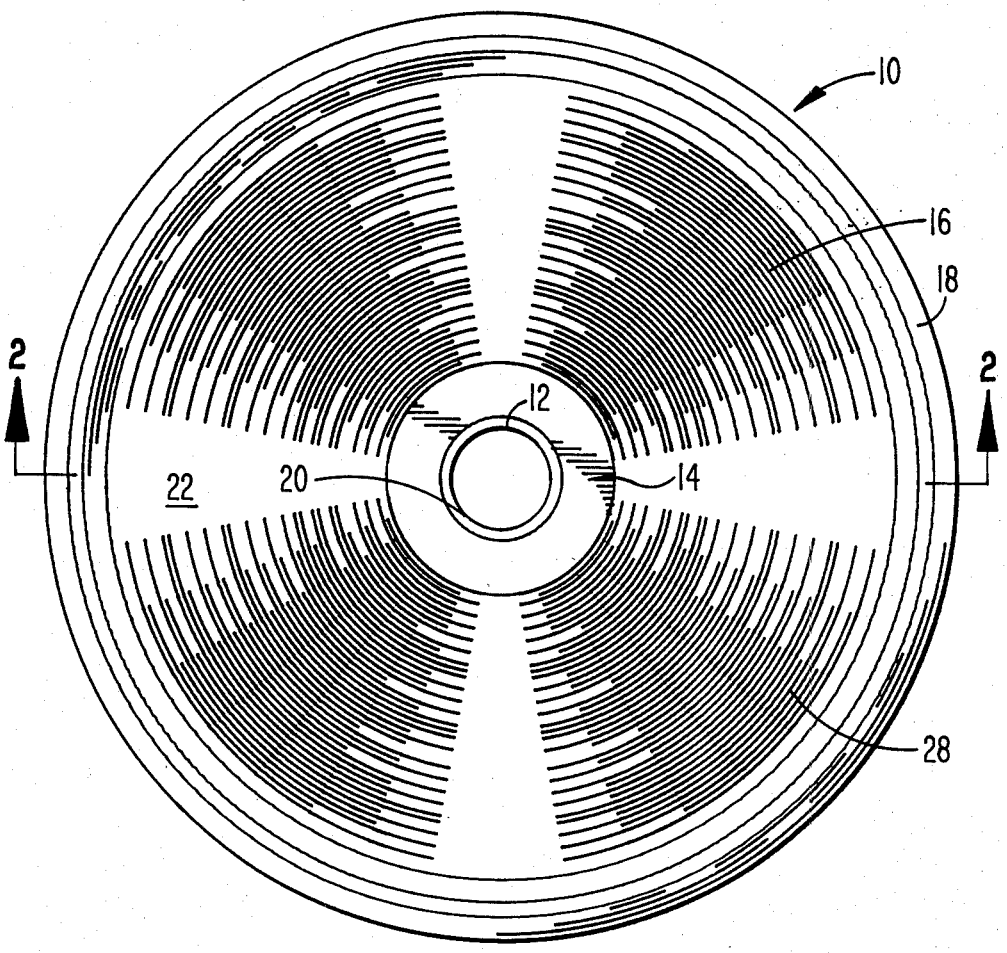
FIG. 1 is a top plan view of a stamper having shaped inner and outer edges.
Figure 2:
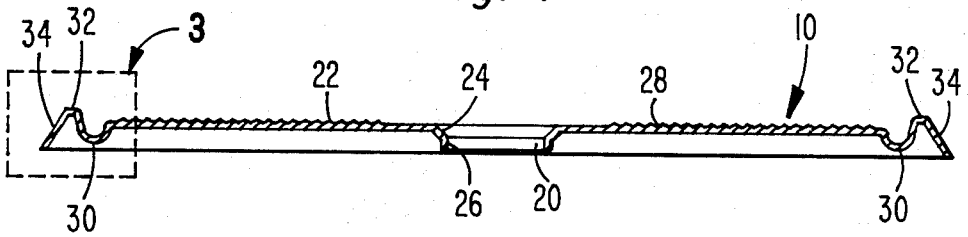
FIG. 2 is a cross-sectional view of the stamper of FIG. 1 taken as indicated by the line and arrow 2 on FIG. 1.

Referring specifically to FIG. 1 and to FIG. 2, FIG. 1 is an illustration of a typical finished stamper of the type typically employed in the molding of audio records and capacitive electronic discs, and FIG. 2 is a cross-sectional view of the stamper shown in FIG. 1.

The flat stamper which is used to form the shaped stamper is illustrated in FIGS. 1 and 2 can be electroformed from various metals or metal alloys or bimetallic combinations of metals. The most commonly used metal is nickel which is deposited from a nickel sulfamate bath. It is also highly advantageous to electroform the flat stampers from certain metal alloys, such as nickel-cobalt, in order to obtain stampers of increased hardness. A further type of stamper which can advantageously be manufactured in accordance with this invention has a surface layer of a hard metal, such as nickel or nickel-cobalt, which is backed up with a relatively soft metal, such as copper.

The stamper 10 illustrated in FIGS. 1 and 2 has a shaped inner edge 12, an unrecorded section 14, a recorded section 16, and a shaped outer edge 18. The shaped inner edge 12 is concentric with the unrecorded area 14 and has a tube-shaped portion 20 which extends away from the recorded surface 22 of the stamper. The tube-shaped portion 20 has a beveled section 24 and a straight section 26. The tube-shaped portion 20 is designed so that the outer surface will engage and lock with the center hole of the molding platen (not shown) when a center pin (not shown) is inserted into the center hole of the platen.

The unrecorded section 14 extends radially outward from the inner edge 12 to the beginning of the recorded area 16. This area is conventionally used for labels on audio records and is employed for the placement of identifying indicia in the case of capacitive electronic discs.

The recorded section 16 is one of the more important sections of the stamper 10 in that it contains the spiral information track 28 in which the program information is recorded. The recorded section 16 extends radially outward from the unrecorded section 14 to the shaped outer edge 18 of the stamper 10. It is important in the manufacture of records that the recorded section 16 does not become scratched or otherwise damaged because any defects in the stampers are reproduced in the molded records. The defects which are molded in the records can cause problems during playback of the records, such as a locked groove, wherein the same section is repeated again and again on playback, or skipped groove, wherein the pickup stylus on playback skips over entire sections of the record. Even minor defects, such as small scratches, can have a significant adverse effect on the playing quality of records and especially capacitive electronic discs in that the small scratches can significantly distort the recorded signal elements in the spiral groove so as to produce either defective signals or entire loss of the signal. It is, accordingly, highly advantageous to have the recorded area of the stamper be as hard as possible so as to resist being scratched or otherwise physically damaged in the molding process.

The shaped outer edge 18 is also a relatively important portion of the stamper 10. The outer edge 18 has a bead forming section 30 which molds the thermoplastic material used to form the record into a protective bead about the outer diameter of the molded record. The shaped outer edge 18 of the stamper 10 also contains a flat section 32 which is used to form a thin band of flash about the bead formed on the record and also functions as the molding land during pressing of records. The outer edge 18 also has a circumferential portion 32 which is bent so as to provide a surface which can be gripped by a locking ring (not shown) and thereby held in engagement with the outer edge of the molding platen (not shown) of the record press. The outer edge 18 is subjected to considerable mechanical work during the pressing of records. This is due to the complex shape of the outer edge 18 and also because the stresses which are caused by the heating and cooling cycles of the molding process are concentrated in the outer edge 18 during molding. Accordingly, it is highly desirable to have the outer edge 18 relatively ductile and free of internal stresses in order to be better able to resist the effects of the thermal cycling inherently encountered in the molding of records.

In accordance with the present invention, the desired results of having a stamper 10 with a recorded area 16 which has a relatively high hardness and inner and/or outer edges 12, 18 which are relatively ductile, is achieved by forming the stamper 10 from metal which, as desposited, is relatively hard and then selectively annealing the inner and/or outer edges 12, 18 of the stamper 10 so as to substantially increase the ductility and relieve the internal stresses at the edges 12, 18.

The flat stamper blank used in the present invention can be manufactured using conventional electroforming techniques to deposit a relatively hard deposit of a metal, such as nickel or an alloy such as nickel-cobalt. The process conditions required for the electrodeposition of the metals in the form of hard deposits, such as the basic bath compositions, the additives which are employed, and the electroforming conditions, are all well-known to those skilled in the art and, therefore, do not require a detailed description. The maximum degree of hardness to which the flat stampers can advantageously be formed is controlled to some extent by whether the inner and outer edges 12, 18 of the stamper 10 are shaped before or after annealing. If the inner and/or outer edges 12, 18 are shaped prior to the annealing, more precise stamping dimensions can be attained, but the degree of hardness to which the stamper 10 can be formed is somewhat limited in that the stamper blank must be sufficiently ductile to permit the shaping of the edges 12, 18 without cracking. If the inner and outer edges are shaped after the edges are annealed, the stamper blanks can be electroformed to a higher degree of hardness since the annealing process will, if properly conducted, decrease the hardness and increase the ductility of the metal at the inner and outer edges and thereby facilitate the shaping of the edges 12, 18 of the stamper.

The selective annealing of the inner or outer edges 12, 18, and, preferably, both edges 12, 18 of the stamper 10, can be conducted using various well-known annealing techniques. The essential requirement of the annealing process is that it be capable of selectively treating the inner and outer edges 12, 18 so as to significantly reduce the hardness and thereby increase the ductility of the metal at these portions of the stamper 10, while not having any significant effect on the hardness of the recorded section 16 of the stamper 10. The annealing step can satisfactorily be performed using the direct application of heat, such as with an oxyacetylene torch or the like. Also, it can be conducted using electric resistance heating and other such similar processes. It has been found that the most preferable method for annealing the stamper edges 12, 18 is induction heating in that the annealing process can be accurately controlled so as to be very selective as to the areas of the stamper 10 which are annealed.

Figure 3:
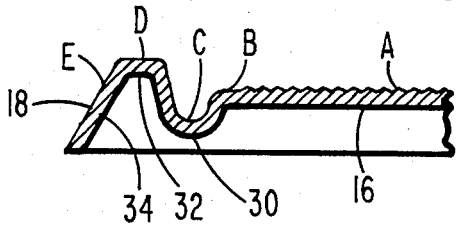
FIG. 3 is an enlargement in cross-section of the outer edge of the stamper taken as indicated by the dotted lines and arrow 3 on FIG. 2.

The degree of selectivity attainable with induction heating can be seen by reference to FIG. 3. In FIG. 3 there is an illustration of a edge section of a stamper 10 which was annealed by induction heating. The Knopp hardness (10 grams load) was measured as well as the bending properties. At point A in the recorded area 16 of the treated stamper, the average Knopp hardness was 243. At point B at the edge of the recorded area 16, the Knopp hardness value was 247. In the bead forming section 30, the average Knopp hardness at point C was reduced to 150. In the flat section 32 of the outer edge 18, the Knopp hardness value was reduced further to 136. At the outermost portion 34 of the outer edge 18, the Knopp hardness value was reduced to only 123. The average bend test values were 18 at point A in the unannealed recorded area of the stamper and 31 at point E in the annealed outermost portion 34 of the stamper. The test values clearly show that the hardness was reduced and the ductility significantly increased in the outer edge 18 of the stamper 10 as compared to the unannealed recorded area 16. In actual use, the stamper 10, treated in accordance with this invention, was shown to have significantly increased life expectancy in comparison to conventional stampers prepared in accordance with the prior art process.

Figure 4:
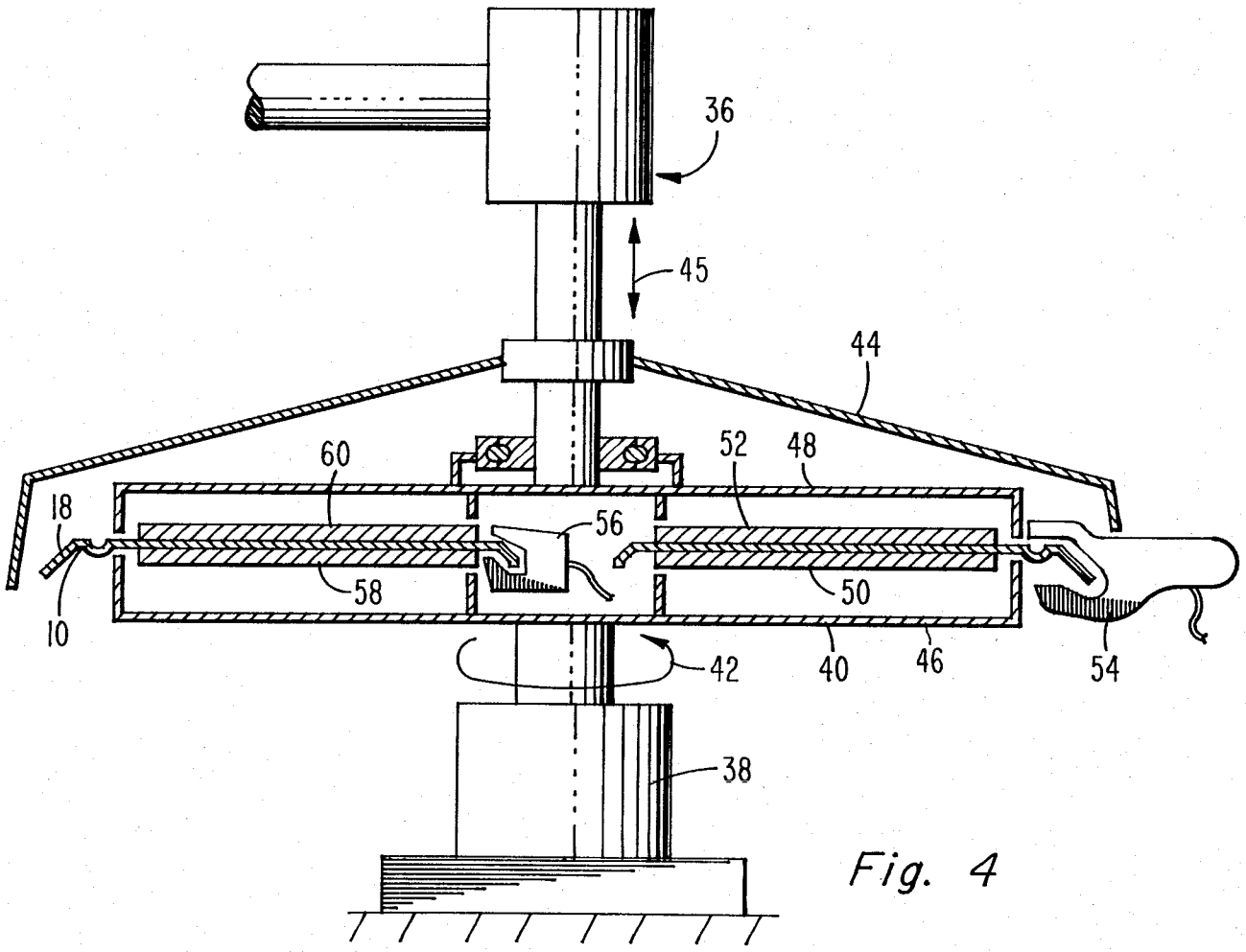
FIG. 4 is a schematic illustration in partial cross-section of an apparatus suitable for annealing the inner and/or outer edges of a stamper of the type illustrated in FIGS. 1 and 2 in accordance with the teachings of this invention.

In FIG. 4 there is an illustration of an apparatus 36 which has been found to be especially useful for annealing the inner and/or outer edges 12, 18 of stampers 10. In the illustration in FIG. 4, a stamper 10, having a shaped outer edge 18 and a shaped inner edge 12, is shown in position within the apparatus 36. It should be appreciated, however, that it is possible to also anneal stamper blanks, that is, flat stampers which have not yet had the inner and outer edges shaped, in the apparatus 36 prior to the shaping of the edges 12, 18. The apparatus 36 includes a base portion 38 in which a drive motor is positioned which drives a lower turntable assembly 40 in a circular direction as indicated by the arrow 42. The apparatus 36 also includes an upper turntable assembly 44 which is designed so as to be moveable in the vertical direction as indicated by the arrow 45. The lower turntable assembly 40 and the upper turntable assembly 44 include shield members 46, 48 which effectively protect the recorded area 16 of the stamper 10. The lower turntable assembly 40 and the upper turntable assembly 44 also have heatsinks 50, 52 which are positioned over the recorded area 16 of the stamper 10 and are designed to remove any heat which travels to the recorded section 16, thereby maintaining the recorded section 16 below the annealing temperature. The apparatus 36 has a induction heating coil assembly 54 positioned so as to be aligned with the outer edge 18 of the stamper 10 to provide a focused induction heating to edge 18 of the stamper 10. In addition, there is a second induction heating coil 56 positioned in alignment with the inner edge 12 of the stamper 10.

In use, the apparatus 36 is operated by initially raising the upper turntable assembly 44 in the upper position. The induction heater 54 for the outer edge 18 and the induction heater 56 for the inner edge 12 are moved out of position. The stamper 10 to be treated is then placed in position on the heatsink 50 associated with the lower turntable assembly 40 with the outer edge 18 and the inner edge 12 outside of the shielding member 46. The induction heating coils assemblies 54, 56 are then brought into alignment with the outer edge 18 and the inner edge 12 of the stamper 10 to be annealed. The upper turntable assembly 44 is then lowered in position so that the upper heatsink 52 is brought into effective heat exchanging contact with the recorded area 16 of the stamper 10. The lower turntable assembly 40 is then activated so as to rotate in the direction indicated by the arrow 42. The upper turntable assembly 44 locks into engagement with the lower turntable assembly 40 and moves in unison with the lower turntable assembly 40. The induction heaters 54, 56 are then energized while the stamper 10 is rotated through the jaws of the induction heaters 54, 56 and the inner and outer edges 12, 18 of the stamper 10 are heated up to a temperature sufficient to cause annealing of the metal at the inner and outer edges 12, 18 of the stamper 10. Once sufficient annealing has been achieved, the energy to the induction coils 54, 56 is interrupted and the stamper 10 is removed from the apparatus 36.

As shown above, using the apparatus 36 of this invention, it is possible to selectively anneal the inner edge portion 12 and the outer edge portion 18 of the stamper 10 while the recorded area 16 of the stamper remain in a hardened condition.

I claim:

1. In the method for the manufacture of a record stamper wherein a flat stamper blank having an inner edge, a recorded section and an outer edge is electroformed from a metal of a first hardness and then the inner edge and the outer edge are shaped to a predetermined configuration, the improvement which comprises: selectively annealing at least one of the edges to reduce the hardness of the metal of the edge to less than that of the first hardness whereby a stamper is obtained having a recorded section of the first hardness and at least one edge of reduced hardness and increased ductility.

2. The method according to claim 1 wherein the outer edge is annealed.

3. The method according to claim 1 wherein the inner edge is annealed.

4. The method according to claim 1 wherein the inner edge and the outer edge are annealed.

5. The method according to claim 1 where at least one of the edges is annealed prior to being shaped.

6. The method according to claim 1 where the inner edge and outer edge are annealed and after annealing the edges are shaped to said predetermined configuration.

7. The method according to claim 1 where at least one of the edges is shaped to the predetermined configuration and then annealed.

8. The method according to claim 1 wherein the inner and outer edges are shaped to the predetermined configuration and thereafter the inner and outer edges are annealed.

9. The method according to claim 1 where the annealing is conducted by induction heating of the inner and outer edges.

10. Apparatus for use in the manufacture of a record stamper of the type having an inner edge, a recorded section and an outer edge, said apparatus comprising in combination: a base support portion, a lower turntable assembly, an upper turntable assembly, a first induction heating means and a second induction heating means; said base support portion including drive means in communication with the lower turntable assembly for rotating the upper and lower turntable assemblies; said upper turntable assembly including means for raising and lowering the upper turntable into and out of engagement with the lower turntable assembly; said upper and lower turntable assemblies each have corresponding shield members for isolating the recorded section of a stamper positioned between the upper and lower turntable assemblies from the inner and outer edges of the stamper and heatsinks positioned to remove heat from the recorded section of the stamper; said first induction heating coil being positioned relative to the lower turntable assembly so as to selectively heat the outer edge of a stamper held between the upper and lower turntable assemblies to the temperature sufficient for annealing and the second induction heating means being positioned relative to the lower turntable assembly so as to selectively heat the inner edge of a stamper held between the upper and lower turntable assemblies to a temperature sufficient for annealing, whereby a stamper can be made having an unannealed recorded section and annealed inner and outer edges.

* * * * *